US006629826B2

(12) United States Patent
Yoon et al.

(10) Patent No.: US 6,629,826 B2
(45) Date of Patent: Oct. 7, 2003

(54) MICROPUMP DRIVEN BY MOVEMENT OF LIQUID DROP INDUCED BY CONTINUOUS ELECTROWETTING

(75) Inventors: Euisik Yoon, Taejon (KR); Kwang-Seok Yun, Taejon (KR)

(73) Assignee: Korea Advanced Institute of Science and Technology, Taejon (KR)

( * ) Notice: Subject to any disclaimer, the term of this patent is extended or adjusted under 35 U.S.C. 154(b) by 4 days.

(21) Appl. No.: 10/051,082

(22) Filed: Jan. 22, 2002

(65) Prior Publication Data

US 2002/0114715 A1 Aug. 22, 2002

(30) Foreign Application Priority Data

Feb. 20, 2001 (KR) ..... 2001-8341

(51) Int. Cl.[7] ..... F04B 17/00; F04F 4/00

(52) U.S. Cl. ..... 417/393; 395/413.2; 395/413.3; 395/92; 395/50

(58) Field of Search ..... 417/393, 395, 417/413.2, 413.3, 478, 92, 50, 285; 204/242

(56) References Cited

U.S. PATENT DOCUMENTS

| | | | | |
|---|---|---|---|---|
| 5,224,843 A | | 7/1993 | van Lintel | 417/413 |
| 5,472,577 A | * | 12/1995 | Porter et al. | 205/799 |
| 6,183,206 B1 | * | 2/2001 | Valenzuela et al. | 417/50 |
| 6,213,735 B1 | * | 4/2001 | Henco et al. | 417/413.2 |
| 6,318,970 B1 | * | 11/2001 | Backhouse | 417/92 |
| 6,458,256 B1 | * | 10/2002 | Zhong | 204/242 |

OTHER PUBLICATIONS

"A Micropump Driven By Continuous Electrowetting Actuation For Low Voltage and Low Power Operations" by Kwang–Seok Yun et al.; The 14$^{th}$ IEEE International Conference On Micro Electro Mechanical Systems; Jan. 21–25, 2001.

G. Beni et al., "Continuous Electrowetting Effect," Appl. Phys. Lett., vol. 40, No. 10, pps. 912–914, May 15, 1982.

J. Lee et al., "Surface–Tension–Driven Microactuation Based on Continuous Electrowetting," Journal of Microelectromechanical Systems, vol. 9, No. 2, pps. 171–180, Jun. 2000.

* cited by examiner

*Primary Examiner*—Cheryl J. Tyler
*Assistant Examiner*—Michael K. Gray
(74) *Attorney, Agent, or Firm*—Oliff & Berridge, PLC

(57) ABSTRACT

The present invention relates to a micropump which is driven by movement of a liquid drop based upon continuous electrowetting actuation. The continuous electrowetting means a phenomenon that the liquid drop moves as the surface tension of the liquid drop is electrically varied in succession. When a tube in which electrolyte and a liquid metal drop are inserted is applied with voltage having periodically changing polarity via metal electrodes, the surface tension of the liquid metal is varied so that the liquid metal drop reciprocates in the tube generating pressure or force, which is used as a driving force of the micropump. The micropump is operated in a low voltage and consumes a small amount of electric power.

19 Claims, 13 Drawing Sheets

MICROPUMP DRIVEN BY MOVEMENT OF LIQUID DROP INDUCED BY CONTINUOUS ELECTROWETTING

BACKGROUND OF THE INVENTION

1. Field of the Invention

The present invention relates to a micropump, in particular, which is driven by continuous electrowetting actuation.

2. Description of the Related Art

Necessity of a micropump treating an ultra-small amount of liquid is being increasingly proposed in various fields such as a micro chemical analysis system, implantable medical devices, micro drug injectors, and a micro manufacturing system.

Conventional micropumps utilize piezoelectric force, electrostatic force, thermopneumatic force, electromagnetic force and the like as driving energy thereof. However, the piezoelectric or electrostatic force requires a high driving voltage of about several hundreds of volt, and the thermopneumatic or electromagnetic force consumes a large amount of electric power. Therefore, the micropumps based upon the foregoing schemes are disadvantageous to be used in the implatable medical devices, a remote environment monitoring system, the handheld chemical analysis system and the like.

U.S. Pat. No. 5,472,577 granted to Mark D. Porter et al., Dec. 5, 1995, discloses a micropump which is driven by electrically changing the surface tension of liquid metal in a vessel. In accordance with this document, the driving energy of the micropump is obtained based upon variation in radius of curvature by electrically changing the surface tension at a surface of the liquid metal contacting with electrolyte.

SUMMARY OF THE INVENTION

Accordingly, the present invention has been devised to solve the foregoing problems of the prior art and it is a technical object of the invention to provide a micropump which has an improved operational characteristic based upon a continuous electrowetting phenomenon.

It is another technical object of the invention to provide a micropump capable of operating with low power consumption and a low operating voltage.

It is further another technical object of the invention to provide a micropump capable of large deflection of membrane compared to a conventional micropump based upon variation of surface tension.

It is another technical object of the invention to provide a micropump having at least two drivers connected in series or parallel to increase pumping pressure and obtain large deflection of membrane.

It is still another technical object of the invention to provide a micropump which is readily fabricated by employing a micro-machining or semiconductor processes.

In accordance with an aspect of the invention for obtaining the foregoing technical objects, a micropump is based upon continuous electrowetting actuation, in which the surface tension of the liquid drop is electrically changed in succession to move a liquid drop. The micropump consists of a driving part containing deflectable thin membrane, a channel which guide the media to be pumped, and check valves which direct the flow of pumping fluid into one direction.

In the micropump of the invention, a driving part includes an elongated capillary tube or a micro tube filled with an electrolyte solution, a liquid drop inserted into the tube, metal electrodes for applying voltage and flexible membranes which are moved by the shoved electrolyte solution as the liquid drop moves.

In the driving part, the voltage applied to the metal electrode forces the liquid drop to move and thus the electrolyte solution, thereby deflecting the flexible membranes. As the voltage is applied to the electrolyte solution via the metal electrodes, surface tension is distributed with different intensity along the surface of the liquid drop in the tube. The difference of surface tension forces the liquid drop to move into one direction. Movement of the electrolyte solution is accompanied, and the membranes blocking both ends of the capillary tube are deflected due to a corresponding pressure.

In accordance with the invention, the driving part is proposed as a driver of the micropump to guide or control the flow of liquid or gas. The liquid drop is inserted into the center of the capillary tube or elongated tube filled with the electrolyte solution. The liquid drop is generally made of oil or liquid metal such as mercury or indium alloy. The electrodes for applying voltage are inserted into the both ends of the tube, which are flared and then blocked with the thin flexible membranes. The flexible membranes constitute an outside wall of the tube through which fluid to be pumped practically flows, and induce the flow of fluid via vertical reciprocation motion. Preferably, the polarity of applied voltage is periodically change in order to induce reciprocation motion of the liquid drop and accordingly vertical reciprocation motion of the membranes. More preferably, the applied voltage is a square wave voltage having a predetermined period and amplitude.

In accordance with another aspect of the invention, the micropump is fabricated by using semiconductor processes or micromachining. A flat substrate such as a glass substrate or silicon substrate is used to form a structure via the semiconductor processes or micromachining. The metal electrodes are formed on the substrate, and the channel in which the electrolyte solution and the liquid drop move can be made of a thick coating material such as a photosensitive film or polymer. Movement of the liquid drop is also transferred to the fluid to be pumped via the flexible membranes blocking the ends of channel.

In accordance with further another aspect of the invention, the driver further includes at least one tube which is identical with the foregoing tube into which one liquid drop is inserted. The at least one additional tube is connected with the foregoing tube in series or parallel to enhance the performance of the micropump. The pumping pressure can be increased with the serial connection of more than two drivers which contain their own liquid drops to be operated. Further, the large deflection of membrane is obtained by increasing the volume of electrolyte solution to be pushed or dragged through the parallel connection of the drives. Moreover, the drivers combine serial connection and parallel connection structures to deflect the membrane by a large amount with a large pumping pressure.

DETAILED DESCRIPTION OF THE PREFERRED EMBODIMENT

Figure 1:
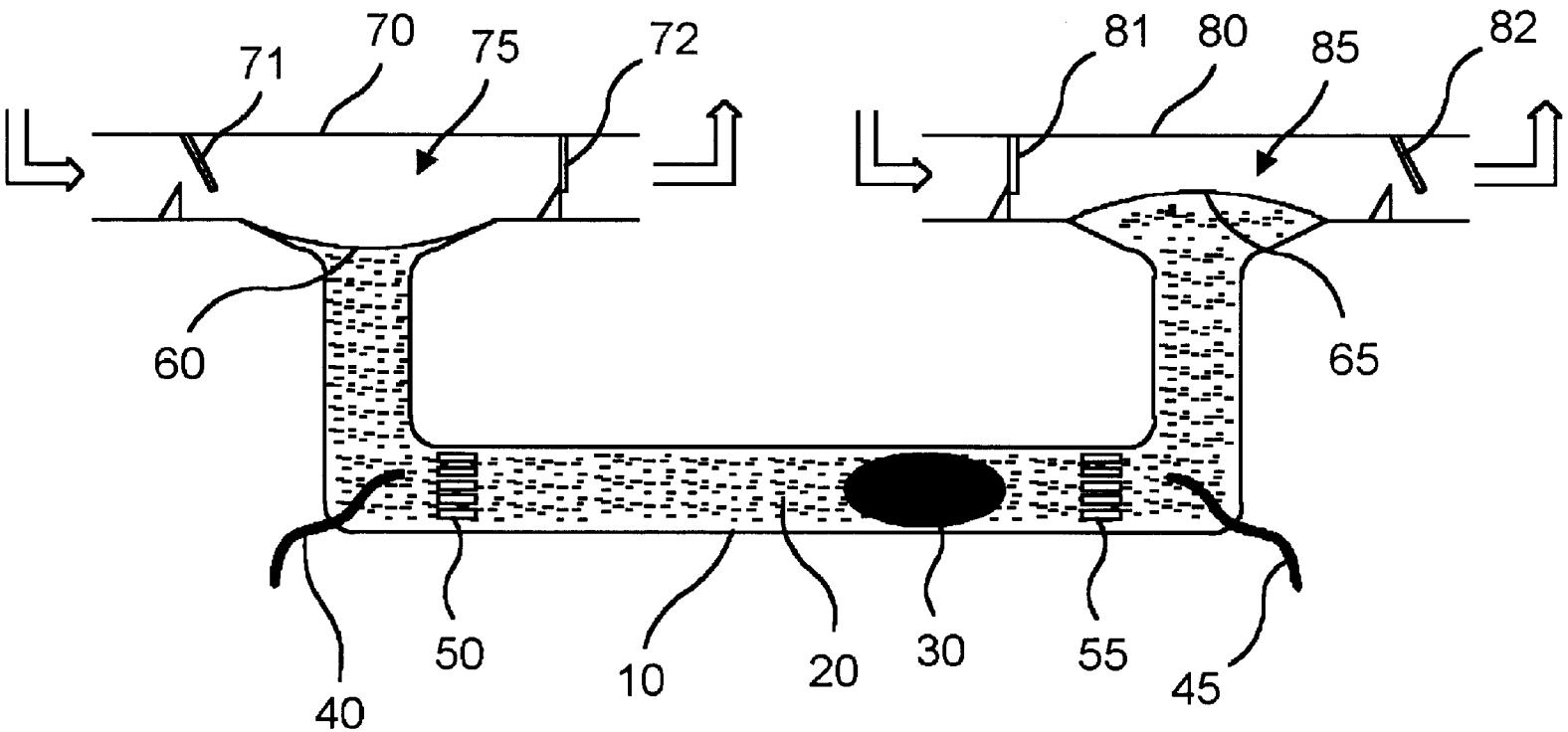
FIG. 1 is a schematic sectional view illustrating a micropump in accordance with the first embodiment of the invention.

The following detailed description will present embodiments of the invention in reference to the accompanying drawings, in which the same reference numerals are used throughout the different drawings to designate the same or similar components.

FIG. 1 is a schematic sectional view illustrating a micropump in accordance with the first embodiment of the invention.

Referring to FIG. 1, the micropump is comprised of an elongated electrolyte storage tube 10 filled with electrolyte 20; a liquid drop 30 inserted into the electrolyte 20 in the storage tube 10; metal electrodes 40 and 45 inserted into the storage tube 10 adjacent to both ends thereof; mesh structures 50 and 55 for preventing reaction between the liquid drop 30 and the metal electrodes 40 and 45; flexible membranes 60 and 65 blocking both ends of the storage tube 10; and fluid-passage tubes 70 and 80 contacting with the flexible membranes 60 and 65 for providing passages to pumping fluid. The fluid-passage tube 70 of pumping fluid has two check valves 71 and 72 to direct the flow of fluid into one direction as indicated with arrows. The fluid-passage tube 80 of pumping fluid also has two check valves 81 and 82 to direct the flow of fluid into one direction as indicated with arrows. The micropump shown in FIG. 1 represents that the fluids in the two different fluid-passage tubes 70 and 80 can be pumped at the same time by using one liquid drop 30, i.e. mercury drop, and the electrolyte storage tube 10. Alternatively, an indium alloy may be used as a material for the liquid drop instead of mercury.

Hereinafter the operation of the micropump shown in FIG. 1 will be described.

When voltage is applied between the metal electrodes 40 and 45, the liquid drop 30 in the tube moves driven by continuous electrowetting actuation. The basic principle of the above phenomenon is disclosed in "Continuous Electrowetting Effect", by G. Beni et all, Appl. Phys. Lett., Vol. 40, page 912, May, 1982, and "Surface Tension Driven Microactuation Based on Continuous Electrowetting (CEW)", by J. Lee et al, Journal of Microelectromechanical Systems, Vol. 198, page 171, 2000. The continuous electrowetting phenomenon takes place at a low voltage of 3V or below, and the actuation of the micropump based upon the continuous electrowetting phenomena consumes a low electric power of several tens of microwatt or below.

The voltage applied to the electrolyte 20 via the metal electrodes 40 and 45 distributes electric charges along the surface of the liquid drop 30 such as a mercury drop with different densities from one another. This causes the difference of surface tension along the surface of the liquid drop 30, thereby forcing the liquid drop 30 to move. As the liquid drop 30 moves, the electrolyte 20 within the storage tube 10 moves together, thereby incurring the flexible membranes 60 and 65 blocking the both ends of the electrode storage tube 10 to deflect in the different direction from each other. A material available for such flexible membranes is one selected from group including silicone rubber, parylene, polyimide, silicon oxide film, silicon nitride film, silicon and the like. The flexible membranes 60 and 65 contact with the fluid-passage tubes 70 and 80 through which the pumping fluids (not shown) flow. When the polarity of voltage applied to the metal electrodes 40 and 45 is periodically changed, the liquid drop 30 performs reciprocation motion, resulting in vertical reciprocation motion of the flexible membranes 60 and 65. When the liquid drop 30 moves to the right, the first membrane 60 moves downward, thereby dropping the pressure within a space 75 of the first fluid-passage tube 70 to open the first check valve 71 while introducing fluid. When the liquid drop 30 moves to the left, the first membrane 60 moves upward, thereby elevating the pressure within the fluid-passage tube 70 to close the first check valve 71 while opening the second check valve 72 to exhaust the fluid in the first fluid-passage tube space 75 in the direction of the arrow. Fluid pumping is also carried out in the same manner in the second fluid-passage tube 80 on the right-hand side.

Figure 2:
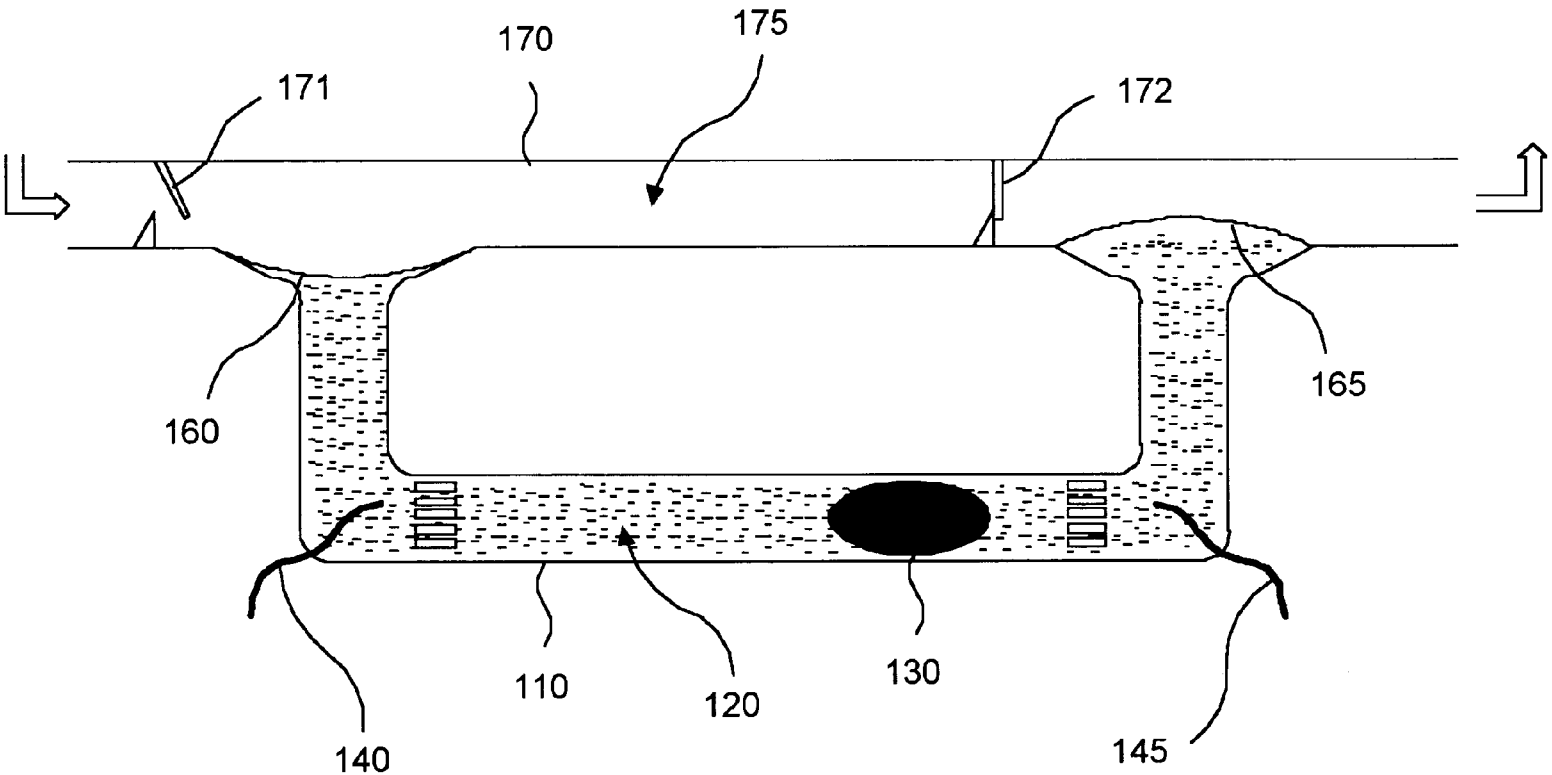
FIG. 2 is a schematic sectional view illustrating a micropump in accordance with the second embodiment of the invention.

FIG. 2 is a schematic sectional view illustrating a micropump in accordance with the second embodiment of the invention.

Referring to FIG. 2, flexible membranes 160 and 165 perform vertical reciprocation motion in a complementary manner according to voltage applied to two metal electrodes 140 and 145 as shown in FIG. 1. When a liquid drop 130 moves to the right, the first flexible membrane 160 moves downward opening the first check valve 171 while introducing liquid. At the same time, the second flexible membrane 165 moves upward shoving the liquid to the right. When the liquid drop 130 moves to the left, the first flexible membrane 160 moves upward and the second membrane 165 moves downward. Then, the first check valve 171 is closed and the second check valve 172 is opened so that fluid reaches the second flexible membrane 165. When the liquid drop 130 moves to the right again, the liquid flows out due to upward movement of the second flexible membrane 165.

Compared to the structure of the first embodiment shown in FIG. 1, this embodiment has an advantage that the pressure pumping fluid is doubled even though only one fluid can be pumped as a drawback.

Figure 3A:
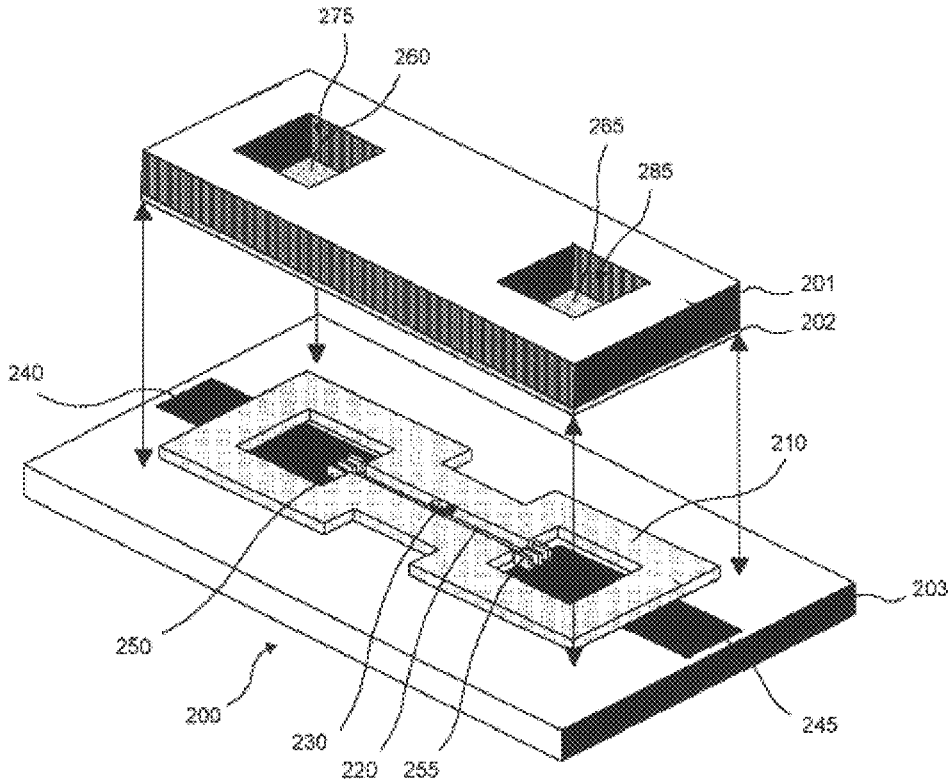
FIG. 3A is an exploded perspective view illustrating a driver of micropump in accordance with an embodiment of the invention.

FIG. 3A is an exploded perspective view illustrating a driver of micropump in accordance with an embodiment of the invention.

The driver 200 is fabricated by using semiconductor processes and a micromachining. Such an electrowetting driver can be fabricated with substrates 201 and 203 made of silicon or glass, in which the substrates 201 and 203 are joined together to perform an adequate function. Alternatively, the substrates may be made of a polymer such as Poly Dimetyl Siloxane (PDMS) or plastic.

Metal electrodes 240 and 245 for applying voltage are formed on the first substrate 203 via the semiconductor processes. Examples of a material available for the metal electrodes may include platinum, iridium and the like which barely chemically react with mercury which is available for a liquid drop 230. On the first substrate 203 is also provided a wall structure 210 functioning as a passage for reciprocal motion of the liquid drop 230 as well as constituting an outside wall of a storage tube of electrolyte 220. The wall structure 210 is made of a material such as photosensitive film, polyimide, silicon oxide film and the like which can be readily formed via the semiconductor processes. Other available materials may include various polymers, glass and the like. On the wall structure 210 is covered with a readily-deflecting flexible membrane 202 for confining the electrolyte 220 and the liquid drop 230. The flexible membrane 202 is covered on the lower part of the second substrate 201 which has through-holes 275 and 285 for allowing flexible membrane portions 260 and 265 contacting a fluid-passage tube (not shown) to deflect in a complementary manner. Examples of a material available for the flexible membrane 202 may include those materials having low values of Young's modulus such as silicon rubber, polymide, parylene and the like. In addition, the available examples further include a silicon oxide film, silicon nitride film, thin-etched silicon film and the like. In this structure also, mesh structures 250 and 255 are provided at both ends of a channel through which the liquid drop 230 reciprocates in order to prevent contact between the liquid drop 230 and the metal electrodes 240 and 245.

Figure 3B:
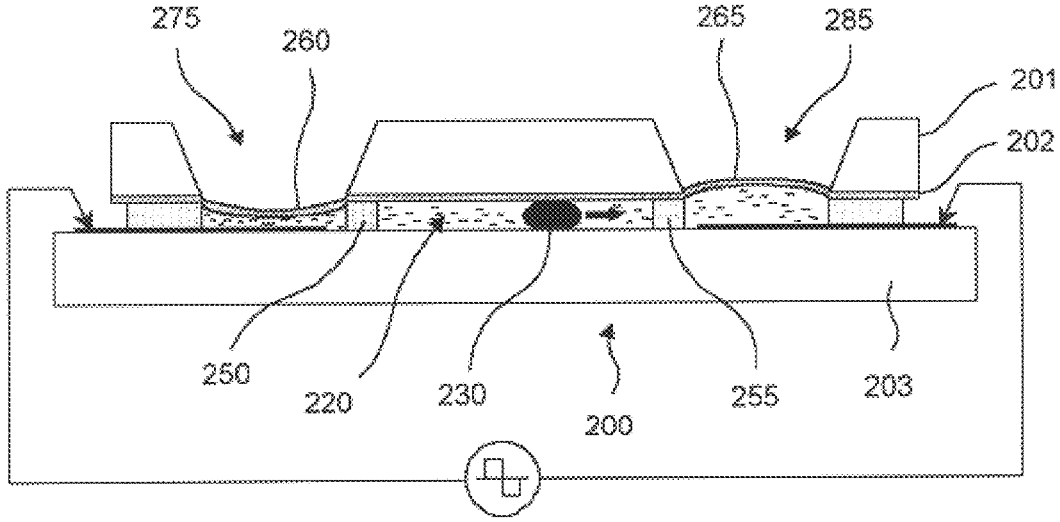
FIG. 3B is a schematic sectional view illustrating the driver shown in FIG. 3A which is cut along the liquid drop reciprocation passage.

FIG. 3B is a schematic sectional view illustrating the driver 200 shown in FIG. 3A which is cut along the liquid drop reciprocation passage.

Referring to FIG. 3B, voltage is applied between the two metal electrodes 240 and 245 to induce reciprocation motion of the liquid drop 230, as in FIG. 1, resultantly obtain vertical reciprocation motion of the flexible membrane portions 260 and 265.

Figure 4:
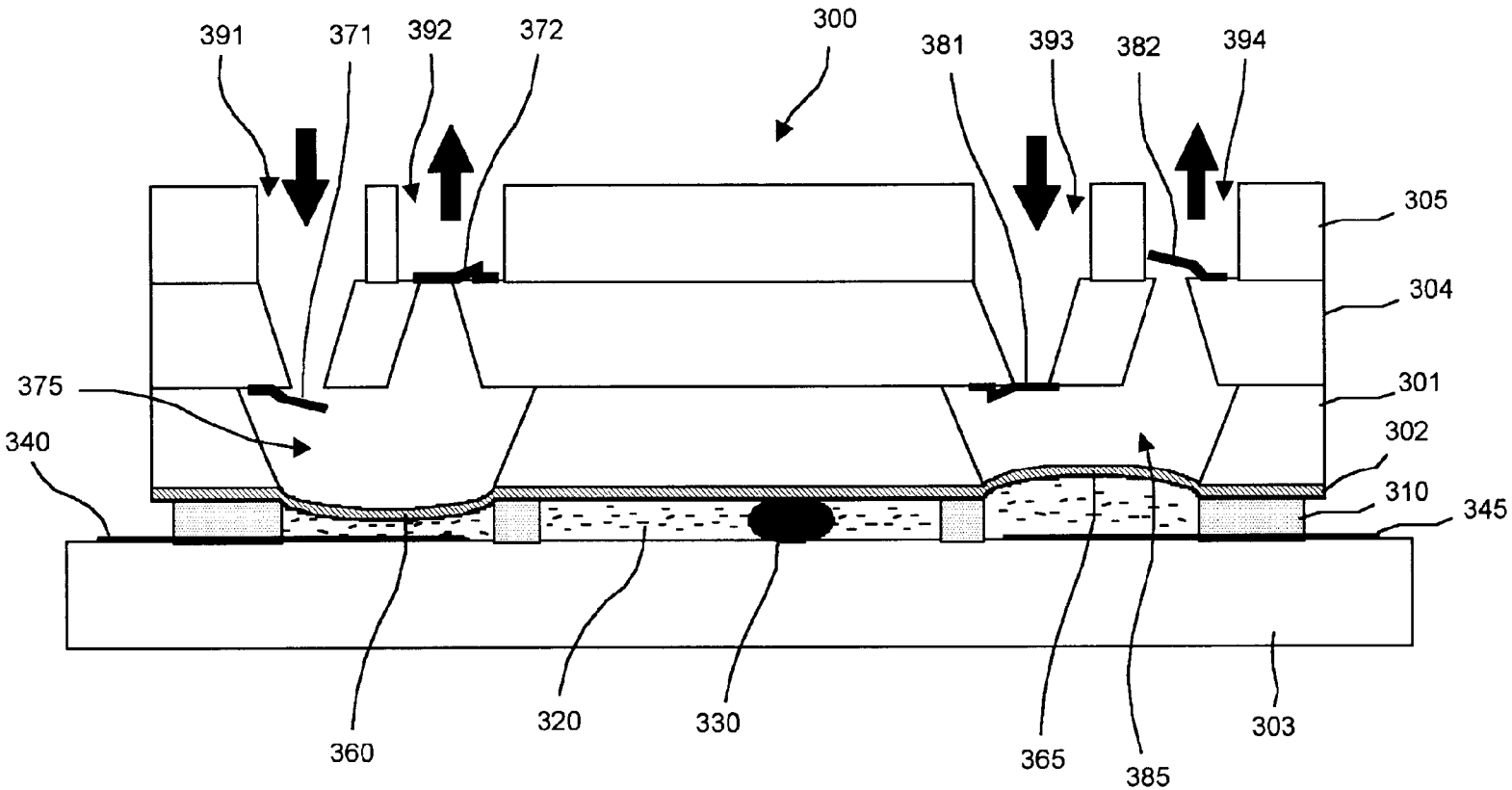
FIG. 4 is a schematic sectional view illustrating an alternative of the first embodiment shown in FIG. 1.

FIG. 4 is a schematic sectional view illustrating an alternative of the first embodiment shown in FIG. 1, in which a micropump 300 is miniaturized and integrated by using semiconductor processes, a micromachining and the like.

The micropump 300 in FIG. 4 has a structure that the third substrate 304 having check valves 371, 372, 381 and 382 is joined on the driver 200 shown in FIG. 3B. As flexible membranes 360 and 365 carry out vertical reciprocation motion due to reciprocation motion of a liquid drop 330, the first chamber 375 contains fluid which flows in through the first inlet 391 and flows out at the first outlet 392 while the second chamber 385 has fluid which flows in through the second inlet 393 and flows out at the second outlet 394.

Figure 5:
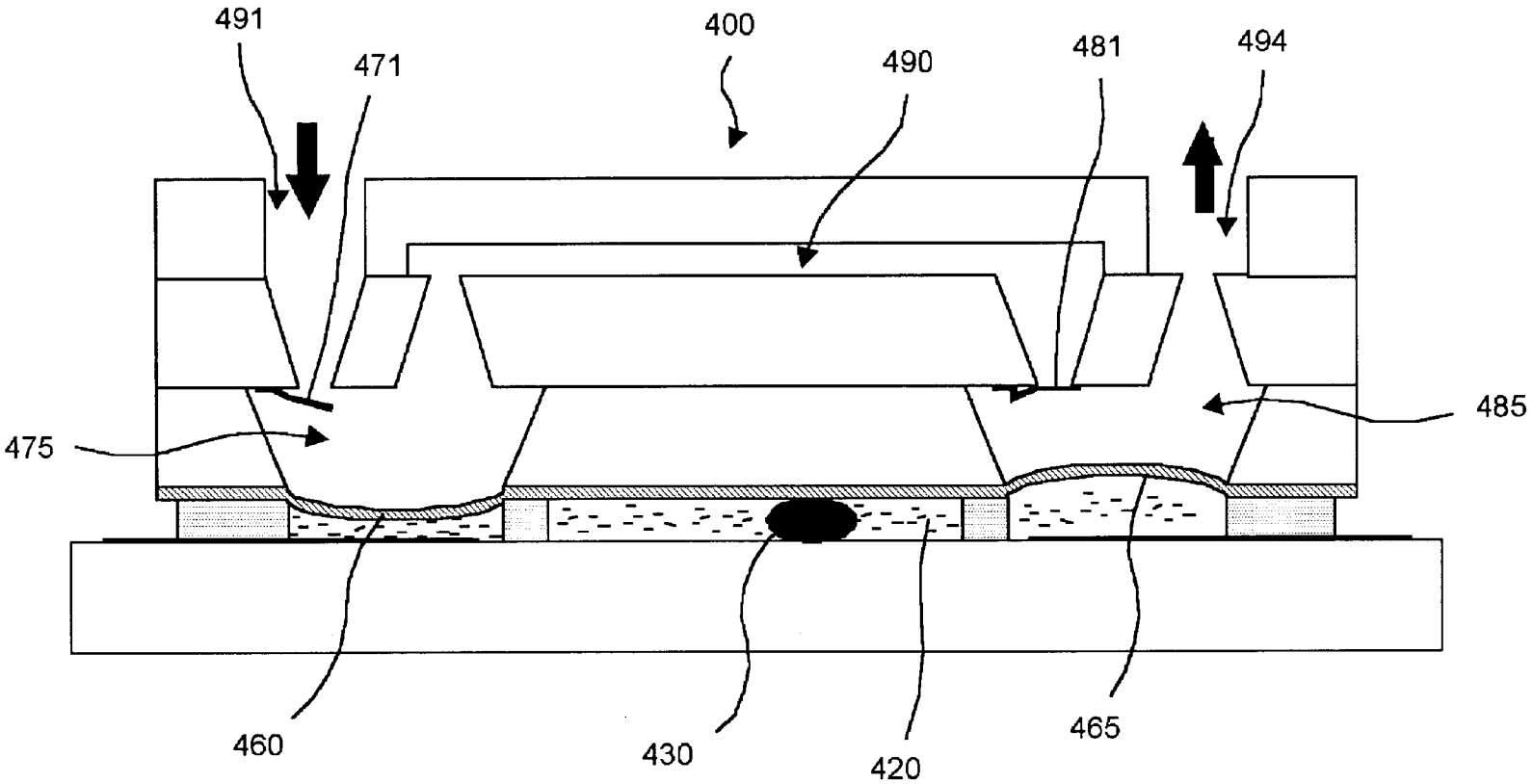
FIG. 5 is a schematic sectional view illustrating an alternative of the second embodiment shown in FIG. 2.

FIG. 5 is a schematic sectional view illustrating an alternative of the second embodiment shown in FIG. 2, in which a micropump 400 is miniaturized and integrated by using semiconductor processes, a micromachining and the like.

Referring to FIG. 5, when a liquid drop 430 moves to the left, the first flexible membrane 460 moves upward while the second flexible membrane 465 moves downward. Then, the first check valve 471 in the first chamber 475 located at an inlet 491 is closed while the second check valve 481 in the second chamber 485 at an outlet 494 is opened to move fluid in the first chamber 475 toward the second chamber 485 through a passage. Now the liquid drop 430 moves to the right, the first check valve 471 is opened to introduce fluid into the first chamber 471 while the second check valve 481 is closed to exhaust fluid in the second chamber 485 through the outlet 494.

Figure 6A:
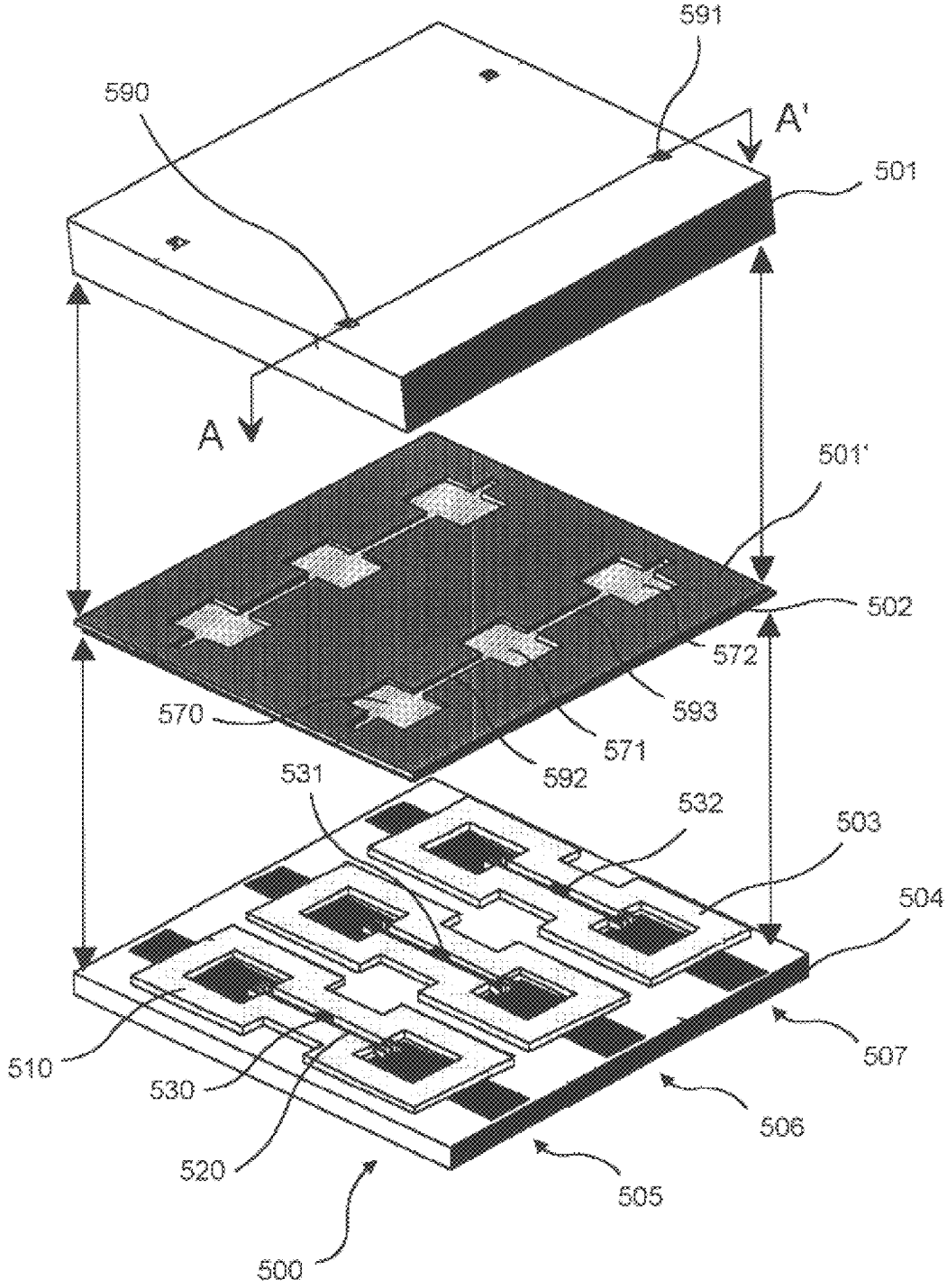
FIG. 6A is an exploded perspective view illustrating a micropump in accordance with the third embodiment of the invention.

FIG. 6A is an exploded perspective view illustrating a micropump in accordance with the third embodiment of the invention.

FIG. 6A shows a peristaltic micropump 500 without a check valve based upon the continuous electrowetting phenomenon. This embodiment employs three drivers 505, 506 and 507 based upon the continuous electrowetting phenomenon. Each of the drivers 505 to 507 is independently operated with each voltage sources so that fluid can flow in one direction due to a peristaltic scheme.

Figure 6B:
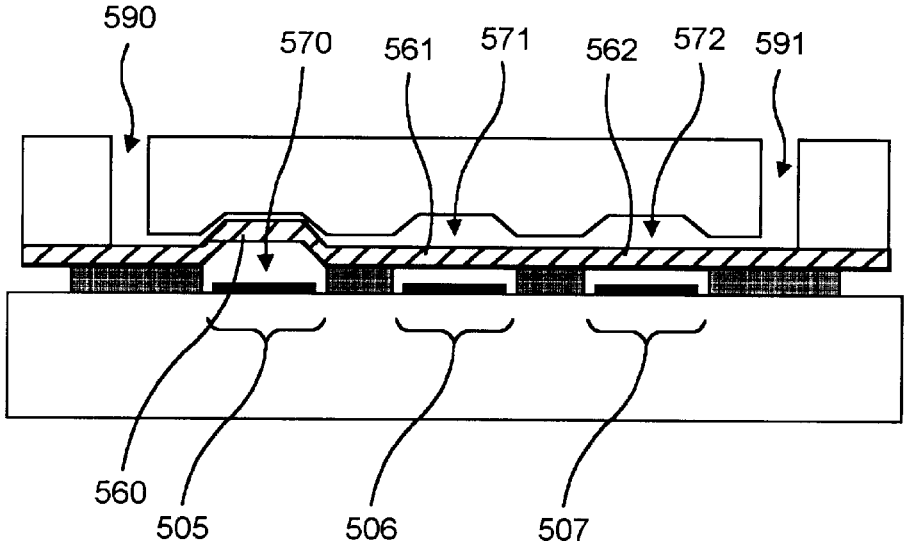
FIG. 6B is a schematic sectional view of the micropump shown in FIG. 6A which is cut along a line A–A'.

FIG. 6B is a schematic sectional view of the micropump shown in FIG. 6A which is cut along a line A–A'.

As can be seen in FIG. 6B, the peristaltic micropump in accordance with this embodiment is structurally different from the micropumps shown in FIGS. 1 to 5 in that chambers 570, 571 and 572 of the peristaltic micropump contacting with flexible membrane portions 560, 561 and 562 are shallow. The shallowness like this allows the flexible membrane portions 560 to 562, when moved upward, to function to shove fluid out of the chambers while serving as valves to shut passages through which pumping fluid flows due to contact with the opposed wall sides. In order to pump fluid in an peristaltic manner, the membranes of the three drivers are vertically moved with an adequate time delay in succession. This can guide the fluid to flow from the inlet 590 side to the outlet 591 side via the three chambers 570 to 572.

Figure 6C:
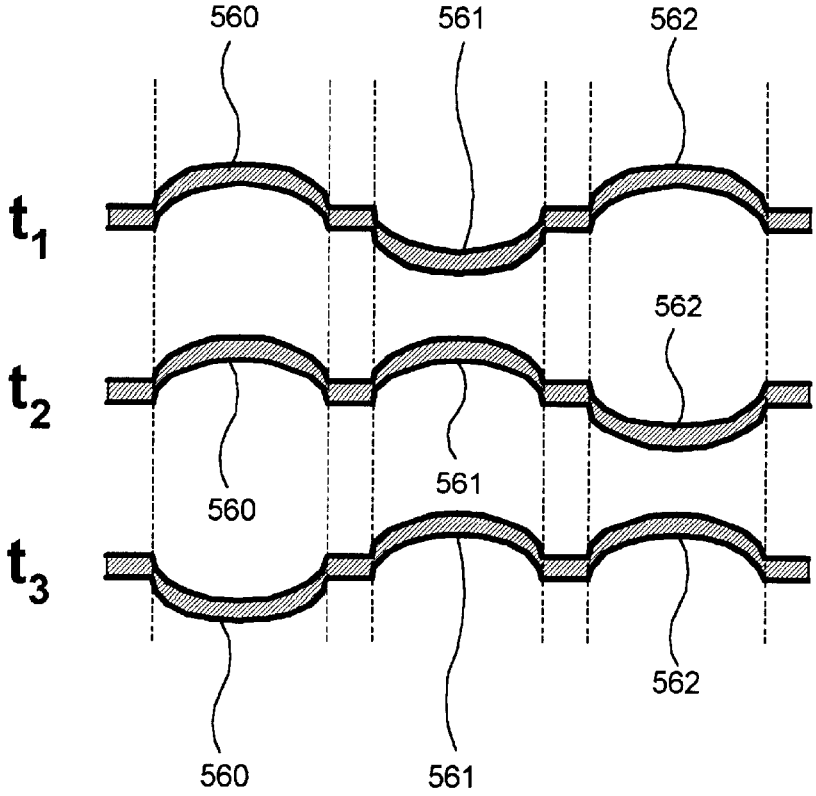
FIG. 6C shows movement of flexible membranes for peristaltic fluid pumping in the micropump shown in FIG. 6A.

FIG. 6C is shows movement of the flexible membranes for peristaltic fluid pumping in the micropump shown in FIG. 6A. FIGS. 6B and 6C will be referred also to explain the operation of the flexible membranes.

At the first time point $t_1$, both of the first and third flexible membranes 560 and 562 move upward, and the second flexible membrane 561 moves downward. At the second time point $t_2$, the second flexible membrane 561 moves upward and the third flexible membrane 562 moves downward to move fluid in the second chamber 571 into the third chamber 572. At the third time point $t_3$, the third flexible membrane 562 moves upward exhausting fluid in the third chamber 572 toward the outlet 591, whereas the first flexible membrane 560 moves downward to introduce fluid from the inlet 590 side into the first chamber 570. Such a series of procedures are repeated so that fluid continuously flows from the inlet 590 side toward the outlet 591 side.

While the micropump structure explained in reference to FIGS. 6A to 6C has been exemplified to comprise six chambers, three chambers practically participate in actuation of the micropump, thereby degrading a device in the aspect of size or efficiency.

Figure 7A:
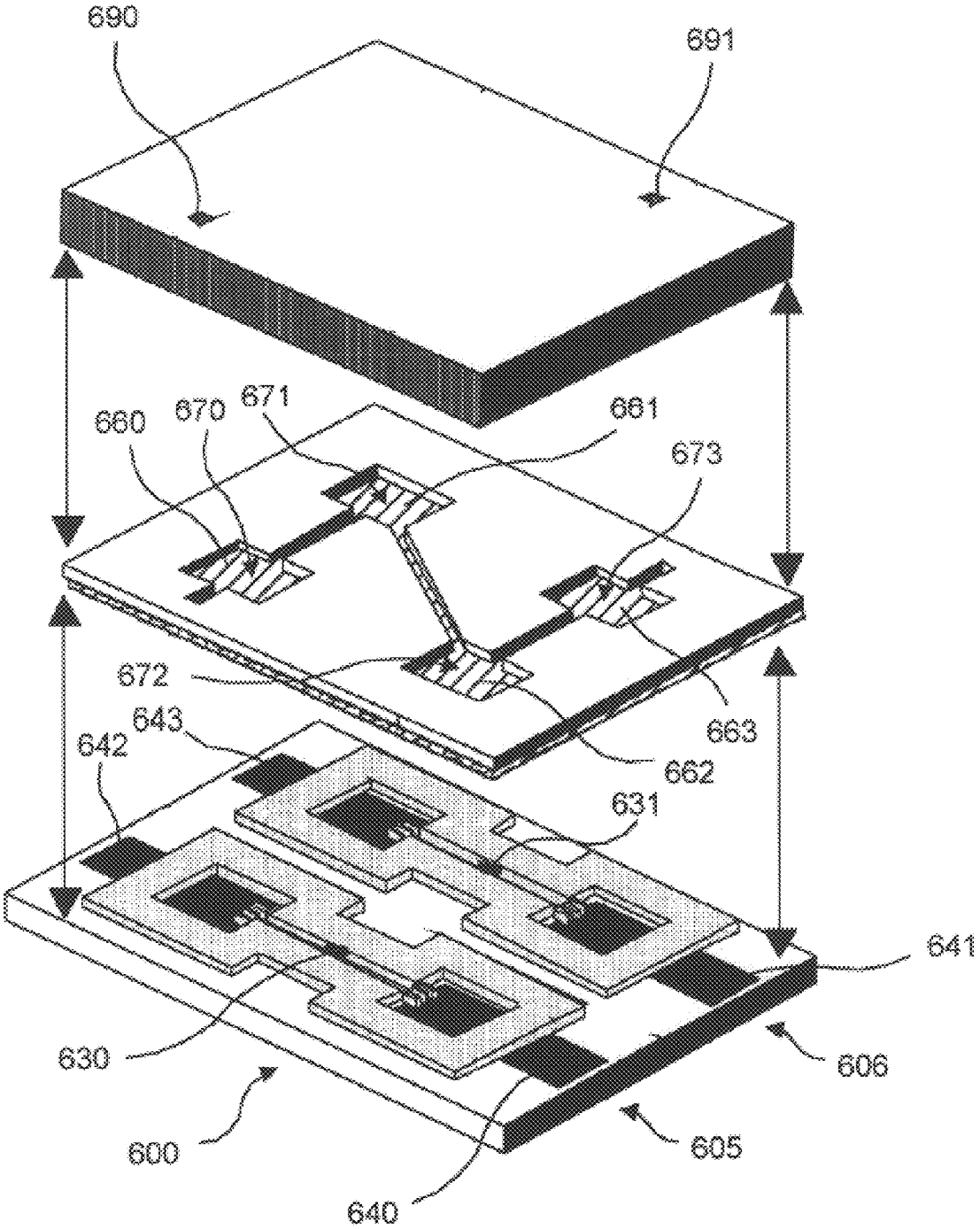
FIG. 7A is an exploded perspective view illustrating a micropump in accordance with the fourth embodiment of the invention.

FIG. 7A is an exploded perspective view illustrating a micropump in accordance with the fourth embodiment of the invention.

FIG. 7A illustrates an alternative embodiment of a peristaltic micropump 600 without a check valve based upon the continuous electrowetting phenomenon. The micropump 600 in accordance with this embodiment has four flexible membrane portions 660, 661, 662 and 663, all of which participate in fluid pumping. Compared to the structure shown in FIG. 6A, the micropump 600 is different in that chambers 670, 671, 672 and 673 contacting with the flexible membrane portions 660 to 663 communicate with one another in series.

Figure 7B:
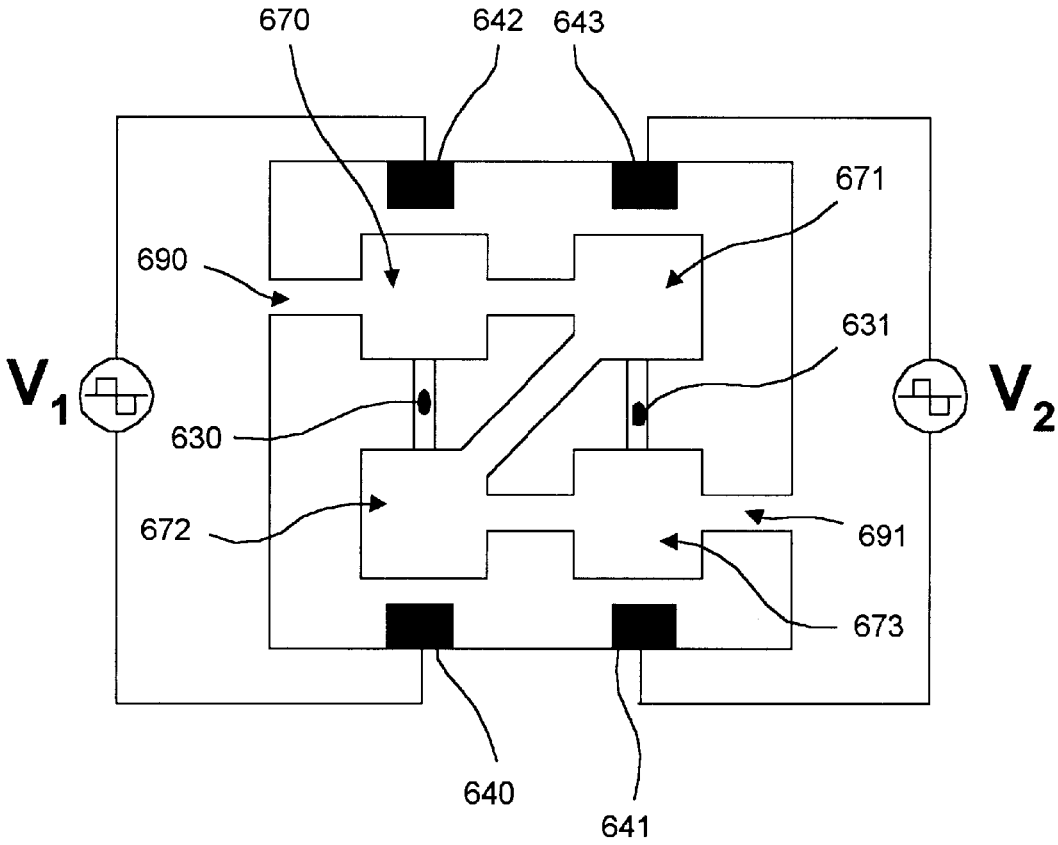
FIG. 7B illustrates the chambers and passages in detail for describing the operation of the micropump shown in FIG. 7A.

FIG. 7B illustrates the chambers and passages in detail for describing the operation of the micropump shown in FIG. 7A.

Referring to FIG. 7B, the first voltage source $V_1$ is connected to first electrodes 640 and 642 in order to control reciprocation motion of the first liquid drop 630. On the other hand, the second voltage source $V_2$ is connected to second electrodes 641 and 643 in order to control reciprocation motion of the second liquid drop 631.

Figure 7C:
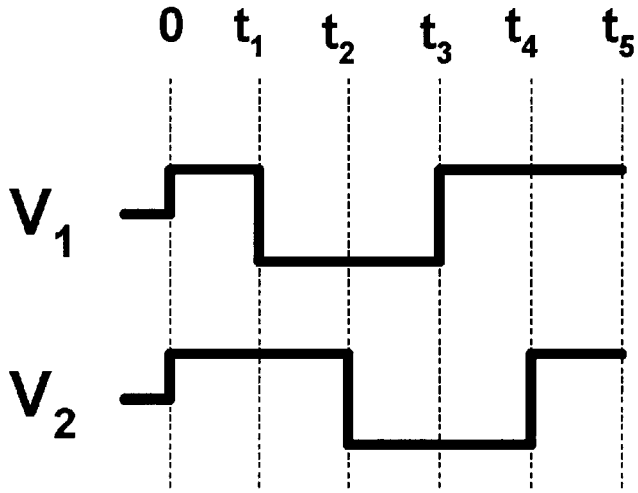
FIG. 7C is a graph illustrating an example of voltage wave-form applied to the voltage sources shown in FIG. 7B.

FIG. 7C is a graph illustrating an example of voltage wave-form applied to the voltage sources shown in FIG. 7B.

Referring to FIG. 7C, the first voltage source $V_1$ maintains the "positive" polarity during time intervals of 0 to $t_1$ and $t_3$ to $t_5$ and the "negative" polarity during a time interval of $t_1$ to $t_3$. On the contrary, the second voltage source $V_2$ maintains the "positive" polarity during time intervals of 0 to $t_2$ and $t_4$ to $t_5$ and the "negative" polarity during a time interval of $t_2$ to $t_4$.

Figure 7D:
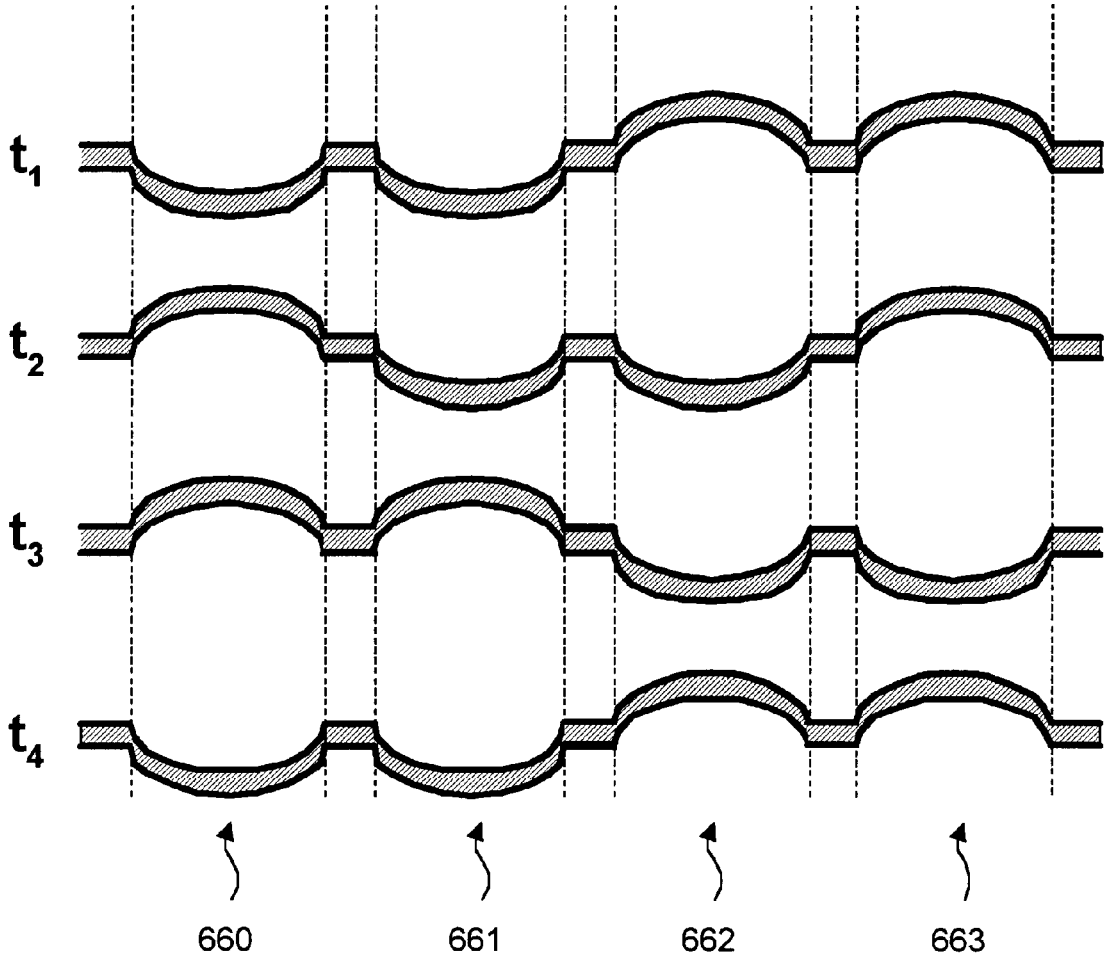
FIG. 7D illustrates movement of four flexible membranes when the voltage wave-forms shown in FIG. 7C are applied to the voltage sources shown in FIG. 7B.

FIG. 7D illustrates movement of the four flexible membranes when the voltage wave-forms shown in FIG. 7C into the voltage sources shown in FIG. 7B.

FIGS. 7A to 7D will be referred to describe the operation of the micropump. In a time period of 0 to $t_1$, the first liquid drop 630 moves toward the third chamber 672 while the second liquid drop 631 moves toward the fourth chamber 673. The first and second flexible membranes 660 and 661 move downward while the third and fourth flexible membranes 662 and 663 move upward. In a time period of $t_1$ to $t_2$, the first liquid drop 630 moves toward the first chamber 670. Then, the first flexible membrane 660 moves upward while the third membrane 662 moves downward so that fluid flows toward the third chamber 672. In a time period of $t_2$ to $t_3$, the second liquid drop 631 moves toward the second chamber 671. Then, the second flexible membrane 661 moves upward and the fluid flows toward the fourth chamber 673. In a time period of $t_3$ to $t_4$, the first liquid drop 630 moves toward the third chamber 672. The first flexible membrane 660 moves downward to introduce the fluid into the first chamber 670 through an inlet 690 while the third flexible membrane 662 moves upward to move the fluid toward the fourth membrane 673. In a time period of $t_4$ to $t_5$, the same state is obtained as in the time period of 0 to $t_1$, so that the second liquid drop 631 moves toward the fourth chamber 673 so that the fluid flows out at an outlet 691. Such a process is repeated so that the fluid continuously flows from the inlet 690 side to the outlet side 691.

Figure 8A:
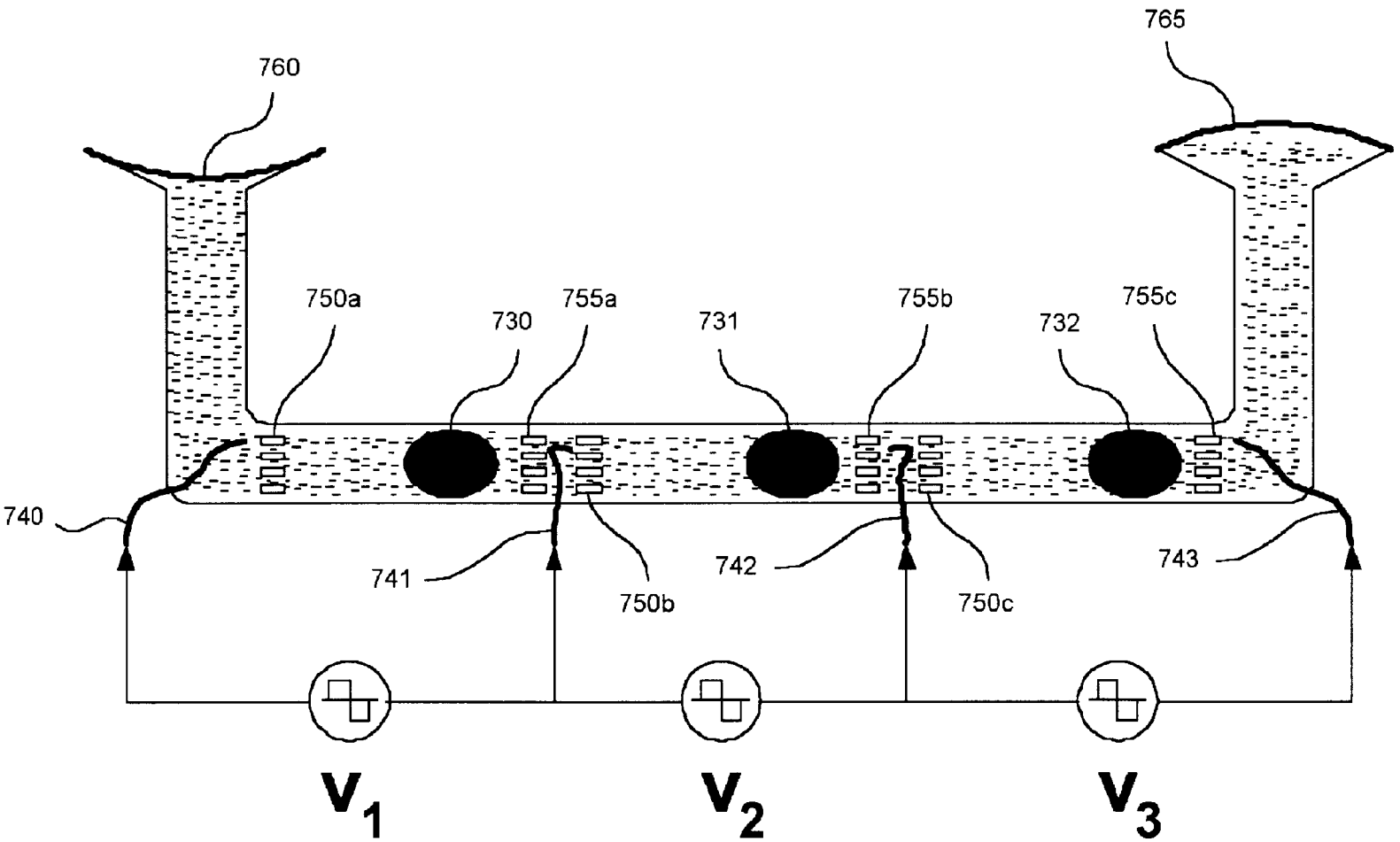
FIG. 8A is a schematic sectional view illustrating a driver of a micropump in accordance with the fifth embodiment of the invention.

FIG. 8A is a schematic sectional view illustrating a driver of a micropump in accordance with the fifth embodiment of the invention, in which fluid-passage tubes and chambers are not shown.

The micropump of this embodiment has a serial connection structure composed of three storage tubes each of which has one liquid drop therein. This structure can obtain a larger pumping pressure over the foregoing one storage tube structures. The three storage tubes are filled with electrolyte in common, and each of the storage tubes has an electrode pair. Total four electrodes 740, 741, 742 and 743 are inserted into the storage tubes because adjacent two storage tubes can share one electrode. However, since mesh structures for preventing reaction between the liquid drops and the metal electrodes cannot be shared between two adjacent storage tubes, each of the storage tubes includes two mesh structures, and thus six mesh structures 750*a*, 755*a*; 750*b*, 755*b*; 750*c*, 755*c* are provided in total. The flexible membranes 760 and 765 are arranged at both ends of the storage tube connection structure. When each of voltage waveforms, which is applied to each of liquid drops 730, 731 and 732 by each of voltage sources, has the same phase or is periodically varies in polarity with a predetermined time delay, the micropump can obtain a triple pumping pressure over the foregoing one storage tube structures.

Figure 8B:
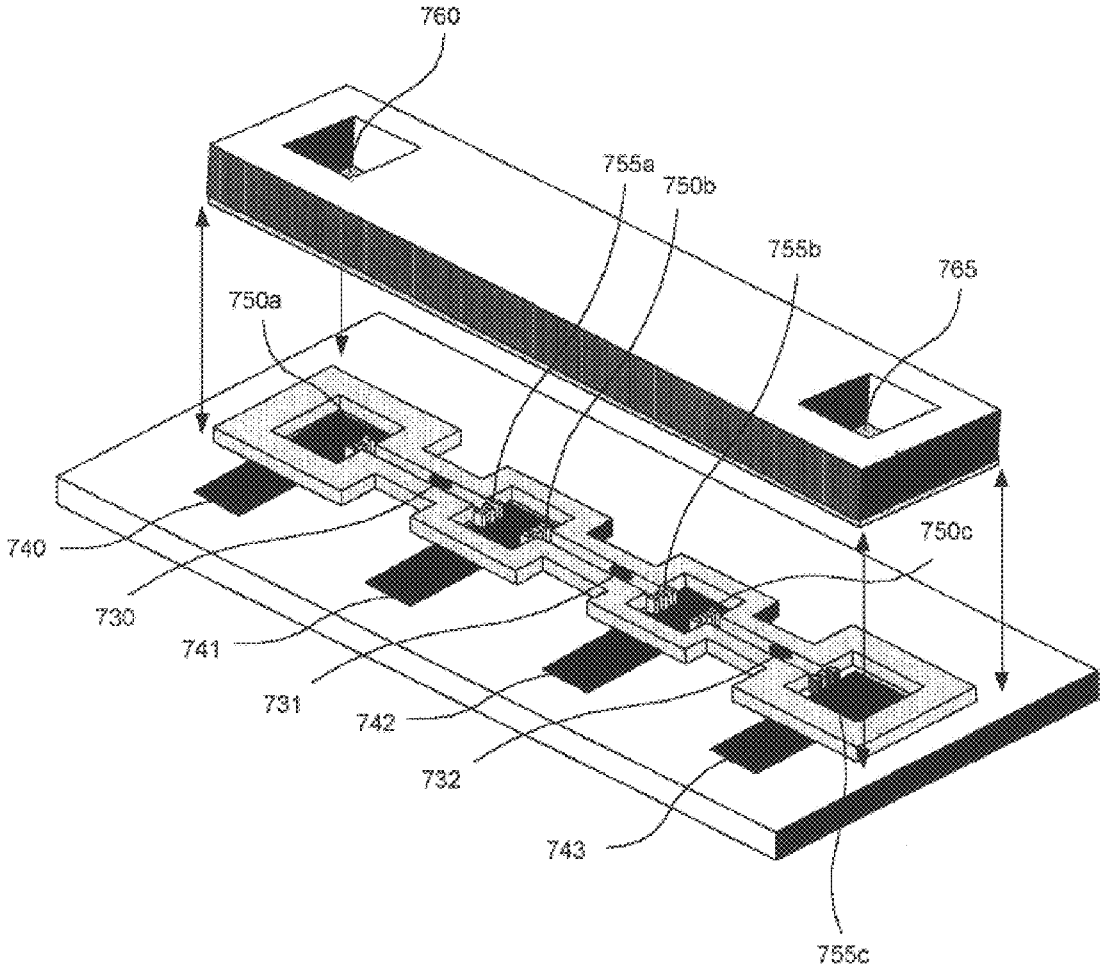
FIG. 8B is an exploded perspective view illustrating the driver of the micropump shown in FIG. 8A.

FIG. 8B is an exploded perspective view illustrating the driver of the micropump shown in FIG. 8A, in which the driver is fabricated on a substrate with semiconductor processes or a micromachining.

Figure 9:
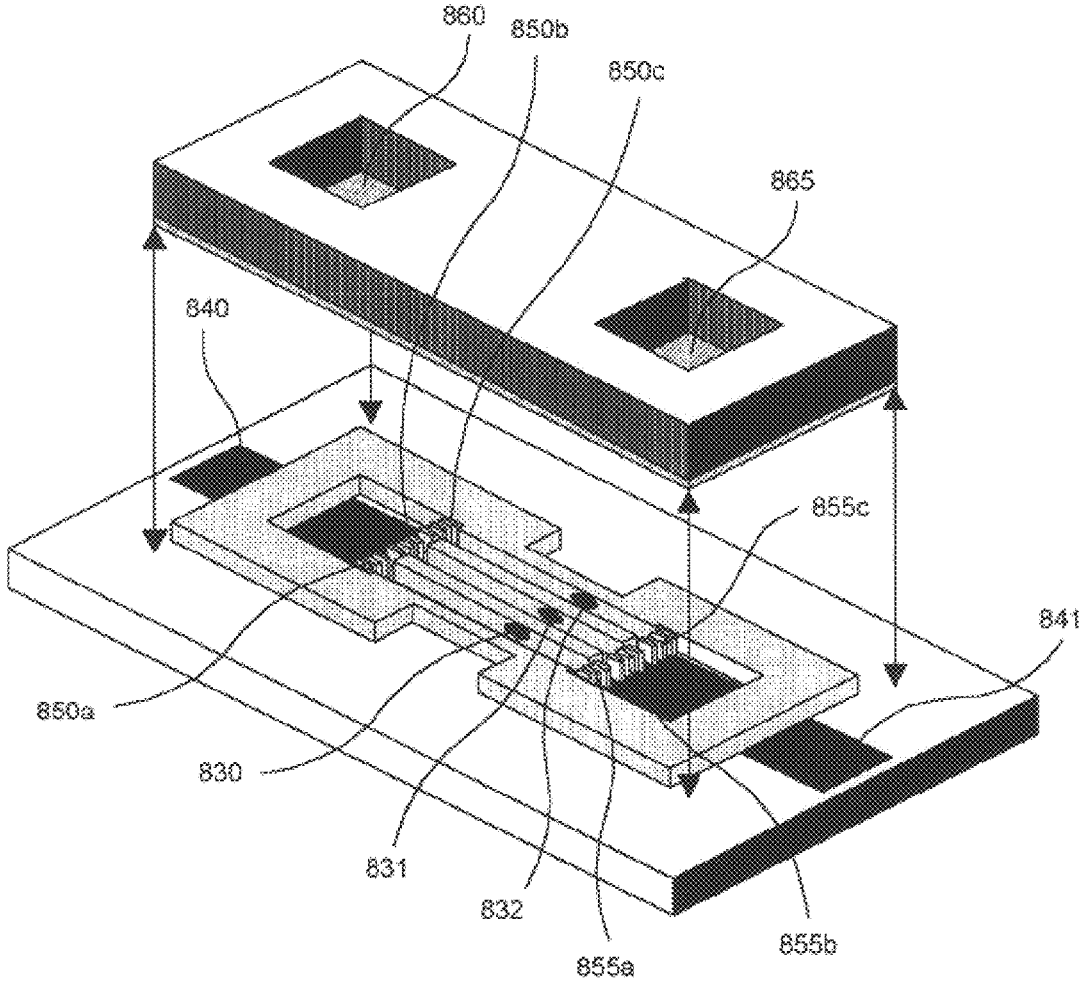
FIG. 9 is an exploded perspective view illustrating a driver of a micropump in accordance with the sixth embodiment of the invention.

FIG. 9 is an exploded perspective view illustrating a driver of a micropump in accordance with the sixth embodiment of the invention, which adopts a parallel structure of three storage tubes each of which contains a liquid drop therein.

The micropump using the driver of this embodiment, by pushing and dragging a larger amount of electrolyte, can obtain large deflection of membrane with the same pumping pressure compared to the structures employing single liquid drop. Therefore, the structure of this embodiment can be applied to such a large area of flexible membrane that cannot be sufficiently deflected via movement of the single liquid drop.

Further, in order to obtain large deflection of the membrane with large pumping pressure, it is apparent that a parallel structure combining serial and parallel connections of tubes can be used, in which each of the tubes contains one liquid drop.

As described hereinbefore, the micropump in accordance with the invention has the following effects:

First, the micropump is driven by the continuous electrowetting phenomenon to lower the driving voltage thereof and accordingly save the power consumption.

Second, the membranes are deflected with reciprocation motion of the liquid drop(s) based upon the continuous electrowetting phenomenon so that deflection of the membranes can be enlarged compared to a conventional method of changing the surface curvature of the liquid drop.

Although the preferred embodiments of the present invention have been disclosed for illustrative purposes, the invention is not restricted to the embodiments and accompanying drawings set forth above, but those skilled in the art will appreciate that various modifications and substitutions can be made without departing from the technical scope of the invention.

What is claimed is:

1. A micropump, comprising:

a liquid drop sealed in a guide channel filled with electrolyte;

two electrodes, an electrode of the two electrodes located at each end of the guide channel and contacting the electrolyte;

flexible membranes attached to the guide channel and contacting the electrolyte, the flexible membranes isolating the guide channel from a pumped fluid; and a fluid channel, a part of which is comprised of the flexible membranes that are deflected back and forth by the driving force converted from linear reciprocation motion of the liquid drop based upon a continuous electrowetting phenomenon.

2. A micropump comprising:

a first component set comprising:

(i) a storage tube, (ii) electrolyte filled into said storage tube, (iii) a liquid drop inserted into said electrolyte, (iv) metal electrodes distanced from both sides of said liquid drop so that said liquid drop reciprocates in said storage tube, (v) a voltage source for applying voltage between said metal electrodes, and (vi) mesh structures arranged between said liquid drop and said metal electrodes to prevent reaction between said liquid drop and said metal electrodes;

flexible membranes blocking both ends of said storage tube;

a fluid-passage tube structure contacting with said flexible membranes to provide a passage through which pumping fluid flows, and having an inlet and an outlet at both ends for introducing and exhausting the pumping fluid; and at least one check valve arranged in said fluid-passage tube to prevent backflow of the pumping fluid in said fluid-passage tube structure.

3. The micropump in accordance with claim 2, wherein said fluid-passage tube structure has separate fluid-passage tubes for said flexible membranes to pump two separate fluids via movement of a single liquid drop.

4. The micropump in accordance with claim 2, wherein said fluid-passage tube structure has a common fluid-passage tube for said flexible membranes to pump one fluid via movement of a single liquid drop.

5. The micropump in accordance with claim 2, further comprising at least one second component set identical and connected in series with said first component set (i) to (vi), wherein said liquid drops separately reciprocate by said voltage sources.

6. The micropump in accordance with claim 5, further comprising at least one third and fourth component sets connected in series with each other and in parallel with said first and second component sets, wherein each of said third and fourth component sets is identical with said first component set.

7. The micropump in accordance with claim 2, further comprising at least one second component set identical and connected in parallel with said first component set (i) to (vi), wherein said metal electrodes positioned at the same side are mutually connected and powered from the same voltage source so that the liquid drops reciprocate in the same direction.

8. The micropump in accordance with claim 2, wherein said storage tubes are formed in a structure on a substrate.

9. The micropump in accordance with claim 2, wherein said storage tubes are made by forming concave grooves in said substrate.

10. The micropump in accordance with claim 2, wherein said liquid drops are made of mercury or indium alloy.

11. The micropump in accordance with claim 2, wherein said membranes are made of one material selected from group including silicone rubber, parylene, polyimide, silicon oxide, silicon nitride and silicon.

12. A micropump comprising:

(i) at least two storage tubes;

(ii) electrolyte filled into said storage tubes;

(iii) liquid drops inserted into said electrolyte;

(iv) metal electrodes distanced from both sides of said liquid drops so that said liquid drops reciprocate in said storage tubes;

(v) voltage sources for applying voltage between said metal electrodes;

(vi) mesh structures arranged between said liquid drop and said metal electrodes to prevent reaction between said liquid drop and said metal electrodes;

(vii) flexible membranes blocking both ends of said storage tubes; and (viii) a fluid-passage tube contacting with said flexible membranes to provide a passage through which pumping fluid flows, having an inlet and an outlet at both ends for introducing and exhausting the pumping fluid, wherein the depth of said fluid-passage tube is so formed that deflection of said flexible membranes shoves the pumping fluid over said membranes while functioning as valves to block the flow of the pumping fluid.

13. The micropump in accordance with claim 12, wherein said flexible membranes are arranged in series in a passage through which at least three fluids flow, each of said flexible membranes being vertically reciprocated in a peristaltic manner to regulate the pumping fluids to flow in one direction while preventing backflow of the pumping fluids without using check valves.

14. The micropump in accordance with claim 12, wherein said storage tubes are formed in a structure on a substrate.

15. The micropump in accordance with claim 14, wherein said structure is made of coating material of a photosensitive film or polymer.

16. The micropump in accordance with claim 12, wherein said storage tubes are made by forming concave grooves in said substrate.

17. The micropump in accordance with claim 16, wherein said substrate is made of one material selected from group including silicon, glass, PDMS and polymer such as plastic.

18. The micropump in accordance with claim 12, wherein said liquid drops are made of mercury or indium alloy.

19. The micropump in accordance with claim 12, wherein said membranes are made of one material selected from group including silicon rubber, parylene, polyimide, silicon oxide, silicon nitride and silicon.

* * * * *